US005309192A

United States Patent [19]

Lu

[11] Patent Number: 5,309,192

[45] Date of Patent: May 3, 1994

[54] PHOTO COATING MACHINE

[76] Inventor: Chia-Chang Lu, No. 68, Lane 127, Kuang Fu Rd., Sec. 2, 7 Ling, Nan Cheng, Ts'3 un, Tien Wei Hsiang Chamghua Hsien, Taiwan

[21] Appl. No.: 933,714

[22] Filed: Aug. 24, 1992

[51] Int. Cl.[5] ..... G03D 5/00

[52] U.S. Cl. ..... 354/317

[58] Field of Search ..... 354/331, 336, 319–324, 354/354; 118/46, 58, 262, 668; 156/230, 234, 163, 164

[56] References Cited

U.S. PATENT DOCUMENTS

| | | | |
|---|---|---|---|
| 4,060,441 | 11/1977 | Ohta et al. | 156/234 |
| 4,447,468 | 5/1984 | Keable | 427/54.1 |
| 4,796,556 | 1/1989 | Bird | 118/46 |
| 4,924,801 | 5/1990 | Arnone | 118/58 |
| 5,077,570 | 12/1991 | Schell | 354/354 |

*Primary Examiner*—D. Rutledge
*Attorney, Agent, or Firm*—Bacon & Thomas

[57] ABSTRACT

An improved photo coating machine of the present disclosure is used to put an evenly distributed coating of chemical fluid on the surface of a photograph so as to form a protective film thereon. The photo coating machine is equipped with a roller assembly, a driving mechanism, a coating device, a drying device, a micro adjustment mechanism, and an adjustment mechanism and a mounting base. The rollers of the roller assembly are disposed with each other in rotational abutment but not in linear alignment. Coating chemical fluid is sprayed between two of the rollers that evenly distribute the chemical fluid upon the surface of a photo that is fed between the rollers. Each roller of the roller assembly is provided with a peripheral groove at each end thereof for the collection of excess chemical fluid on the rollers which is recycled to the coating device so as to prevent the mounting base from contamination. The micro adjustment and the adjustment mechanisms are responsible for varying the space between each pair of the rollers so that photos of different sizes can be fitted therebetween.

6 Claims, 4 Drawing Sheets

PHOTO COATING MACHINE

BACKGROUND OF THE INVENTION

The present invention relates to an improved photo coating machine which can put a thin film of chemical fluid on the surface of a photo for protection purpose.

To well protect a favorite or preferred photo, it is the conventional method to put the photo in a plastic cover which is then well sealed all around by way of a heated roller. The previous plastic cover is made of relatively hard polyvinyl chloride ( PVC ); but it has been replaced in recent years by soft plastic material.

In the conventional photo covering process, it is frequently found that some air is left in the cover and sealed therein, resulting in the creation of air bubbles in the cover. Moreover, if the process of covering a photo is performed in a hurry that the photo is easily located in an offset manner due to the carelessness of the person handling the process. Furthermore, the covered photo must be carefully trimmed to provide a quality finish, a time consuming and costly procedure.

SUMMARY OF THE INVENTION

Therefore, the primary object of the present invention is to provide an improved photo coating machine which can put an evenly distributed thin film of a chemical fluid upon the surface of a photo to form a protective film after the coating is heated dry. This speeds up the conventional processing of covering a photo with a protective cover and lower the cost effectively.

Another object of the present invention is to provide an improved photo coating machine which is equipped with a roller assembly wherein the main roller thereof and the chemicals distribution roller is disposed in rotational abutment against each other with the center line, joining the centers thereof, at 45 degrees with a horizontal line, and the vertical center line of the forwarding roller is 2–4 mm offset from the vertical line passing the center of the main roller so as to permit a processed photo to be bent upwardly after passing through the main roller and the forwarding roller with the coating chemical fluid being evenly distributed on the surface of the photo.

One further object of the present invention is to provide an improved photo coating machine which can prevent air bubbles from generating on the coated photo and can also avoid the use of a conventional hard plastic cover to protect a photo.

One still further object of the present invention is to provide an improved photo coating machine which is provided with a slanted groove on each side board of the mounting base for the mounting of the main roller of the roller assembly whereby the same can be easily detached from the mounting base for replacement of the superficial cover disposed on the surface of the main roller.

DETAILED DESCRIPTION OF THE PREFERRED EMBODIMENT

Figure 1:
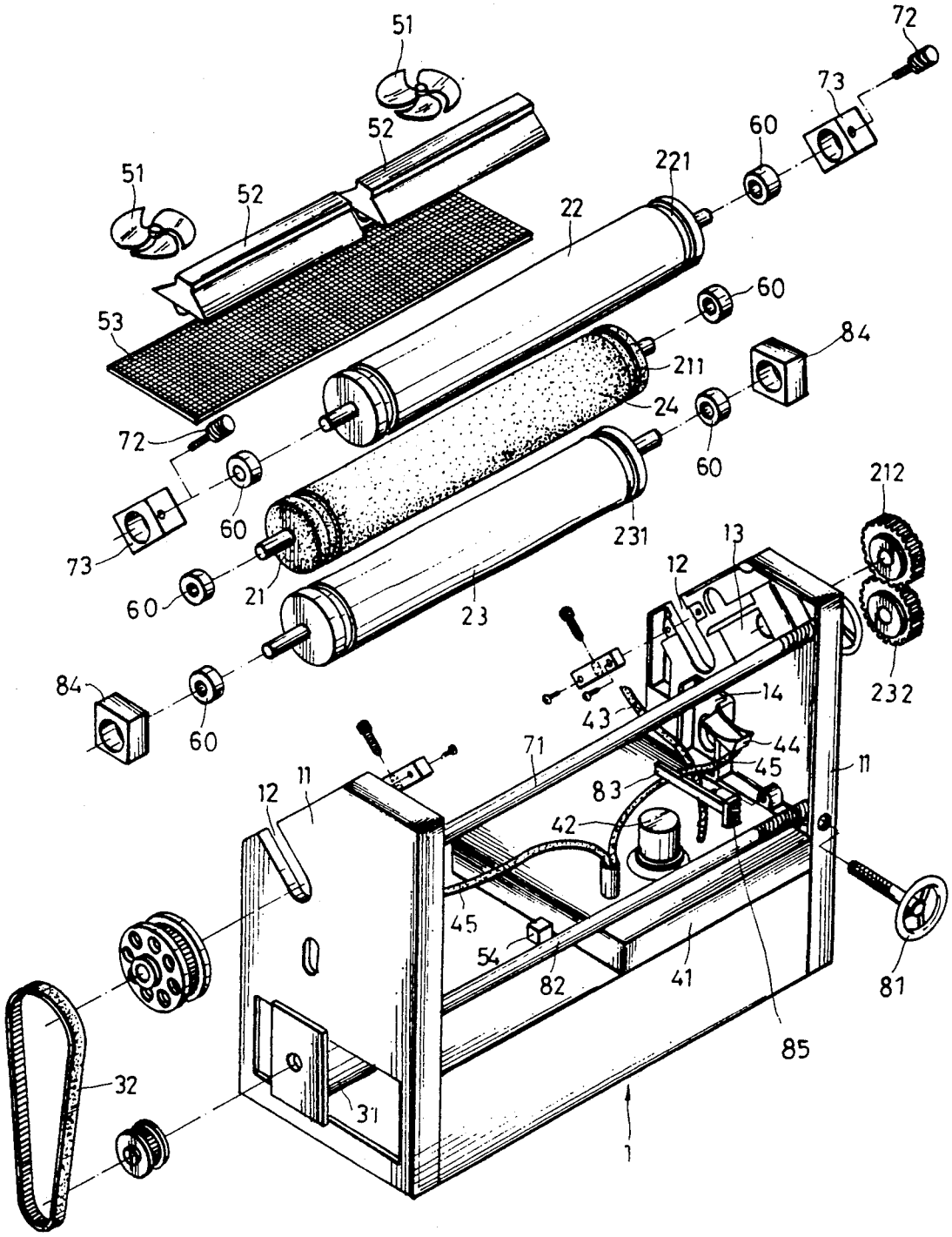
FIG. 1 is an exploded perspective view showing the components of the present invention.
Figure 2:
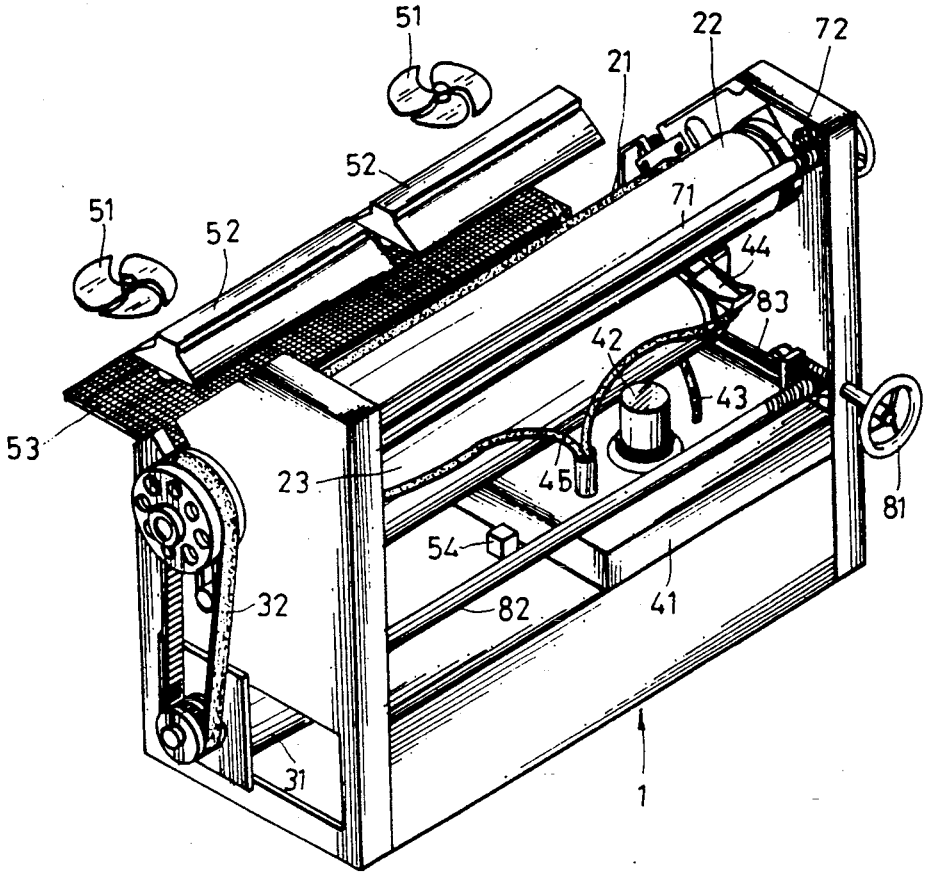
FIG. 2 is a partially exploded perspective view showing the assembled coating machine of the present invention.

Referring to FIGS. 1, 2, the present improved photo coating machine comprises a mounting base 1, a roller assembly, a driving mechanism, a coating device, a drying device, a micro adjustment mechanism an adjustment mechanism.

The mounting base 1 is provided with a pair of side boards 11 each having a 45-degree slant engagement slot 12 for the mounting of a main roller 21. The inner side of each side board 11 is provided with a first guide groove 13 on top of the slot 12 for the mounting of a first sliding block 73 of the micro adjustment mechanism and below the engagement slot 12 is disposed a second guide groove 14 in which is disposed a slidable second sliding block 84.

The roller assembly includes a main roller 21, a distribution roller 22 and a forwarding roller 23 that are of the same structure. The surface of the main roller 21 is covered with a layer of rubber 24; and each end of the main roller 21 is provided with a peripheral groove 211 and a bearing 60 is attached to each end thereof. The main roller 21 is secured to the side boards 11 by engaging the bearings 60 with the engagement slots 12 respectively and the bearings 60 are fixed in place. To the right end of the main roller 21 is attached a gear 212.

Figure 4:
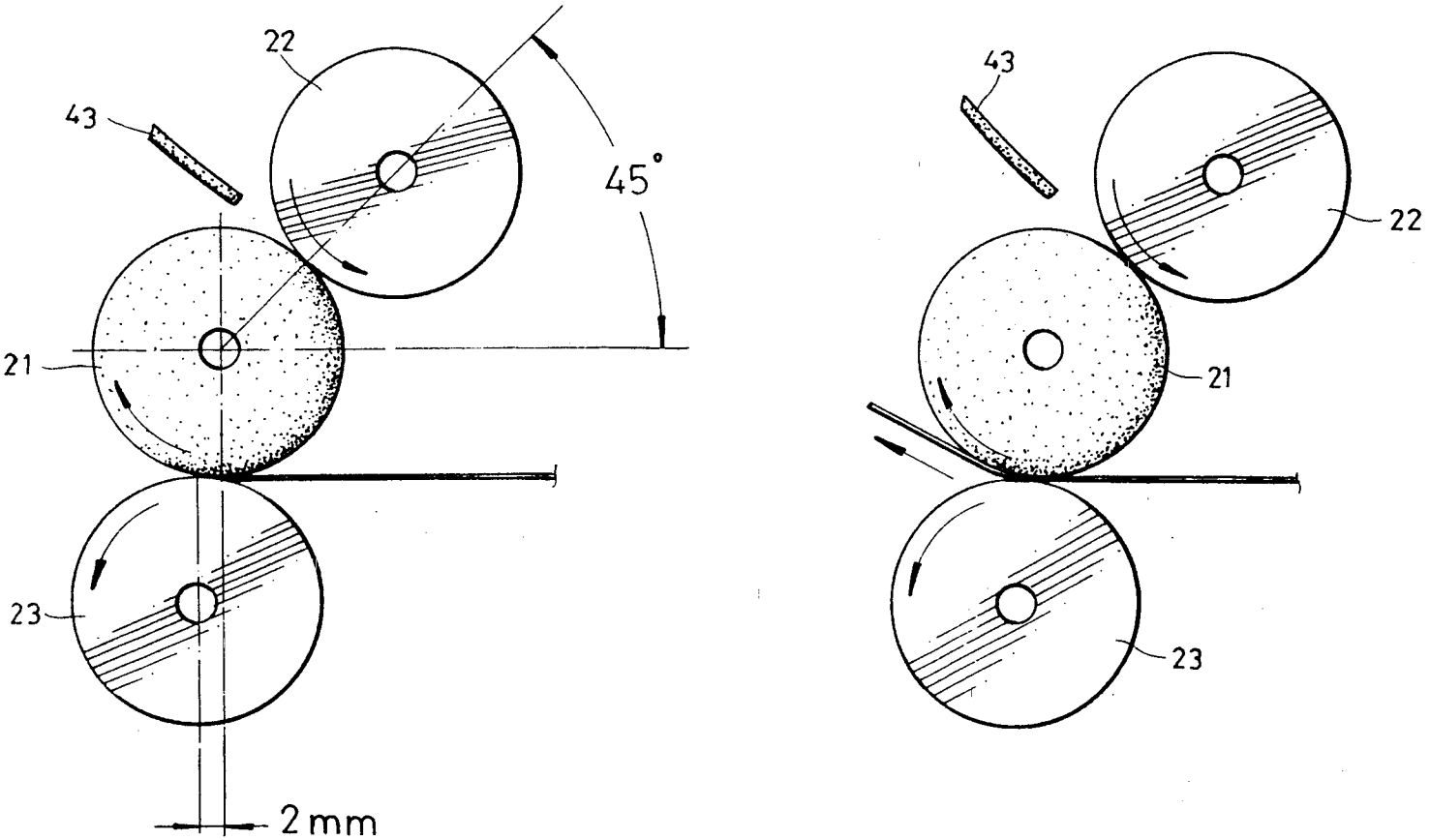
FIG. 4 is a diagram showing the arrangement of the roller assembly and the practical operation thereof.

The distribution roller 22 is disposed above the main roller 21 with a center line, joining the centers of the two rollers 21, 22, at a 45-degree intersection with a horizontal line, as shown in FIG. 4. Each end of the ditribution roller 22 is provided with a peripheral groove 221 and a bearing 60 which is then engaged with the first sliding block 73.

The forwarding roller 23 is disposed under the main roller 21 with the vertical center line thereof offset from the vertical center line of the main roller 21 by 2–4 mm, as shown in FIG. 4; and each end of the forwarding roller 23 is provided with a peripheral groove 231 and a bearing 60 which is engaged with a second sliding block 84. The right end of the forwarding roller 23 is provided with a gear 232 which is in engagement with the gear 212 secured to the right end of the main roller 21.

The driving mechanism is comprised of a motor 31 and a toothed drive belt 32. The motor 31 is disposed at the bottom of the mounting base 1 and drives the main roller 21 through the drive belt 32.

The coating device is disposed under the roller assembly and is comprised of a chemical reservoir 41, a pump 42, a spraying pipe 43, a collection tank 44 and a recollection pipe 45. The chemical coating fluid is stored in the reservoir 41 and is forced out by the pump 42, and the chemical is charged into the spraying pipe 43 and is delivered to the place at which the main roller 21 and the distribution roller 22 come into abutment with each other. Excessive chemical fluid will flow to the respective peripheral grooves on the rollers and drip into the collection means 44 disposed under each end of the main roller 21 and is recollected by the recollection pipe 45 into the reservoir 41.

The drying device disposed at the back of the roller assembly is comprised of a fan 51, a quartz electric heating tube 52, a net plate 53 and an induction switch 54 wherein the quartz electric heating tube 52 is disposed under the fan 51 and the net plate 53 is located under the heating tube 52. The induction switch 54 is disposed in front of the roller assembly and will be actutated to operate when a photo to be coated is sensed being fed into the machine and the fan 51 and the heating tube 52 are supplied with electricity to operate for drying the output coated photo.

The micro adjustment mechanism adapted for adjustment of the distribution roller 22 is comprised of an upper worm 71, a worm gear 72 and a sliding block 73. The upper worm 71 is disposed across the side boards 11 of the mounting base 1 and the upper worm 71 is engaged with the worm gear 72 which is secured to the first sliding block 73 whereby the rotation of the worm 71 will make the worm gear 72 spin so that the first sliding block 73 is able to be moved up and down accordingly so as to vary the abutment condition or spacing between the distribution roller 22 and the main roller 21.

Figure 3:
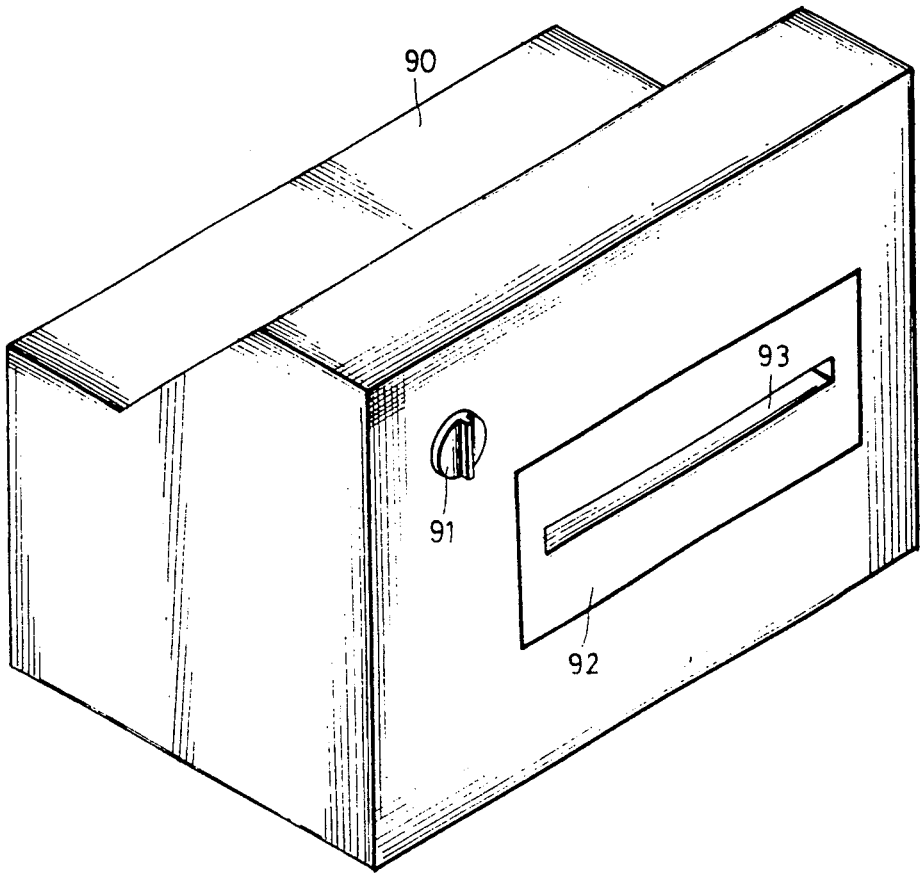
FIG. 3 is a diagram showing the coating machine disposed within an outer casing.

Referring to FIG. 3, the present coating machine is housed in an outer casing 90 which is provided with a start switch 91 at the upper left corner, and a door 92 disposed at the middle of the front side thereof. The door 92 provided with an elongated slot 93 for receiving a fed photo is openable to facilitate the addition of the coating chemical fluid, and the cleaning of the roller assembly and the adjustment of the space between the rollers. A photo is fed into the coating machine via the elongated slot 93 and then coated and dried in the machine and is delivered out of the casing 90 at the back thereof.

A worm gear 85 is secured to one end of each lever arm 83 and is in turn engaged with the lower worm 82 which is engaged with a turning wheel 81. The other end of the lever arm 83 is in abutment against the bottom of the second sliding blocks 84 and is slidably disposed in the second sliding blocks 84 so that the rotation of the turning wheel 81 will make the lever arms 83 disposed at each end of the lower worm 82 to move upward or downward, resulting in the lifting or lowering of the forwarding roller 23 whereby the space between the main roller 21 and the forwarding roller 23 can be varied accordingly.

As shown in FIG. 4, the vertical center lines passing through the centers of the main roller 21 and the forwarding roller 23 are offset from each other by 2–4 mm so that the photo passing therethrough will be automatically bended upwardly. The main roller 21 and the distribution roller 22 are disposed with the center line thereof, joining the centers of the main roller 21 and the distribution roller 22, and intersecting a horizontal line at an angle of 45 degrees to dispose the two rollers in operational abutment with each other. The main roller 21 is covered with a superficial layer of rubber 24 so that the coating chemical fluid sprayed therebetween can be evenly distributed all over the main roller 21 and also over a fed-in photo with no air bubbles produced on the coated photo. In order to fit photos of different sizes between the main roller 21 and the forwarding roller 23, the space therebetween can be adjusted for easy passage of the photos.

Due to the high volatility of the chemical fluid used in the coating machine, the pump 42 must continue delivering the chemical fluid to the main roller 21 so as to prevent the chemicals thereon from drying out, and the leftover or excessive chemical fluid will flow naturally into the peripheral grooves 211 as a result of the centrifugal force, and the fluid accumulated therein will drip into the collection means 44 and be led to the chemicals reservoir 41 by a recollection pipe 45.

When the rubber layer 24 on the main roller 21 is worn out due to constant abrasion against the distribution roller 22 and must be replaced, the main roller 21 can be easily detached from the machine without disassembling the whole roller assembly by simply taking the main roller 21 off the slots 22 of the side boards 11.

It can be apparently seen that the present photo coating machine can carry out the coating of photos at a fast speed and the film coated on the surface of the photos can be free from air bubbles produced therein. Moreover, the cost thereof can be effectively lowered.

I claim:

1. An improved photo coating machine adapted for provision of a protective film on the surface of a photo comprising:

a mounting base having a pair of side boards disposed on the right and left side thereof respectively;

a roller assembly disposed between said side boards of said mounting base being made up of a main roller, a chemicals distribution roller and a forwarding roller wherein said main roller is superficially covered with a layer of rubber and is provided with a bearing means at each end thereof and a gear means is disposed at the right end thereof; and said distribution roller is disposed on top of said main roller with a bearing means secured to each end thereof which is engaged with a first sliding block respectively; said forwarding roller is located under said main roller with a bearing means secured to each end thereof which is then secured to a second sliding block and a gear means secured to the right end thereof is engaged with said gear means at the right end of said main roller; each end of said main roller, distribution roller and said forwarding roller is provided with a peripheral groove respectively;

a driving mechanism including a motor and a toothed drive belt wherein said motor is disposed at the bottom of said mounting base and is associated with said main roller by way of said toothed drive belt;

a coating device disposed under said roller assembly including a chemicals reservoir, a pump means, a collection means and a recollection pipe;

a drying device disposed at the back of said roller assembly including a fan, a quartz electric heating tube; a net plate and an induction switch; said heating tube being disposed under said fan and said net plate being disposed under said heating tube and said induction switch being disposed in front of said roller assembly;

a micro adjustment mechanism disposed at the ends of said distribution roller including an upper worm, worm gears and said first sliding blocks;

an adjustment mechanism disposed in association with said forwarding roller including a lower worm, a turning wheel, a pair of lever arms, and second sliding blocks;

2. An improved photo coating machine as claimed in claim 1 wherein said distribution roller is disposed on top of said main roller with the center line thereof, joining the centers of said two rollers, intersecting with a horizontal line at 45 degrees; and said main roller and said forwarding roller are disposed in such a manner that each vertical center line passing through each center thereof respectively is offset by 2–4 mm whereby a fed in photo can pass the space between said two rollers and is automatically bent upward with said coating chemical fluid evenly distributed on the surface of said photo.

3. An improved photo coating machine as claimed in claim 1 wherein said side boards of said mounting base are provided with an open slot disposed at an angle of 45 degrees with respect to a horizontal line into which the ends of said main roller can be located; on top of each said slot is disposed a first guide groove into which said first sliding block secured to each end of said distribution roller can be slidably located; a second guide groove is disposed under each said slot into which said second sliding block secured to each end of said forwarding roller can be slidably located.

4. An improved photo coating machine as claimed in claim 1 wherein said collection means is disposed under each said peripheral groove disposed at each end of said main roller so as to recollect the excessive coating chemical fluid in said peripheral groove.

5. An improved photo coating machine as claimed in claim 1 wherein said upper worm of said micro adjustment mechanism is disposed across said side boards and is associated with said worm gears secured to said first sliding blocks respectively at one end thereof so that the rotation of said upper worm can vary the space between said main roller and said distribution roller having its ends engaged with said first sliding blocks.

6. An improved photo coating machine as claimed in claim 1 wherein said turning wheel of said adjustment mechanism is engaged with said lower worm disposed across said side boards of said mounting base and said lever arm having one end thereof provided with worm gear engaged with said lower worm is in abutment against the second sliding blocks at the other end thereof to which said forwarding roller is mounted whereby the rotation of said turning wheel can make the forwarding roller move up and down so as to vary the space between said forwarding roller and said main roller.

* * * * *